US006834438B1

(12) United States Patent
Heister

(10) Patent No.: US 6,834,438 B1
(45) Date of Patent: Dec. 28, 2004

(54) TILE TEMPLATE

(76) Inventor: Thomas J. Heister, 178 E. Fullerton Ave., Glendale Heights, IL (US) 60139

( * ) Notice: Subject to any disclaimer, the term of this patent is extended or adjusted under 35 U.S.C. 154(b) by 0 days.

(21) Appl. No.: 10/331,888

(22) Filed: Dec. 31, 2002

Related U.S. Application Data

(60) Provisional application No. 60/353,262, filed on Feb. 4, 2002.

(51) Int. Cl.[7] ..... G01B 3/14; B43L 7/00

(52) U.S. Cl. ..... 33/566; 33/562; 33/563; 33/DIG. 20; 33/526; 33/1 B; 33/520

(58) Field of Search ..... 33/562, 566, 563, 33/549, DIG. 20, 526–527, 1 B, 1 G, 520, 644, 670, 121, 387, 392, 749.11, 747.11; 52/387, 392, 749.11, 747.11

(56) References Cited

U.S. PATENT DOCUMENTS 4,659,409 A * 4/1987 Arafat ..... 33/527
4,827,621 A * 5/1989 Borsuk ..... 33/758
5,083,378 A * 1/1992 Juday ..... 33/520
5,673,489 A * 10/1997 Robell ..... 33/1 B
5,673,490 A * 10/1997 Hill ..... 33/1 B
5,922,157 A * 7/1999 Snider ..... 33/563
6,539,643 B1 * 4/2003 Gleeson ..... 33/563
2003/0061722 A1 * 4/2003 Bradley ..... 33/563

* cited by examiner

*Primary Examiner*—Diego Gutierrez
*Assistant Examiner*—Yaritza Guadalupe
(74) *Attorney, Agent, or Firm*—Matthew J. Peirce

(57) ABSTRACT

A template for use as a guide for cutting and placing tile for residential or commercial use, and a process for using same, is disclosed. Before using the template, a user would need to locate the center of the area onto which tiles would be placed and mark this center location. A user would place the template against the surface to which tiles would eventually be placed and then mark the template with a center mark, indication the eventual corner mark, A user would then be able to use the template to diagram the location of all necessary tiles, whether they be straight tiles or they be cut up tiles. A user would then be able to easily set the tiles by first placing the template against the required surface, and then, fixedly attaching the tiles to the template.

4 Claims, 1 Drawing Sheet

TILE TEMPLATE

This application claims the benefit of No. 60/353,262 filed Feb. 4, 2002.

BACKGROUND OF THE INVENTION

The present invention concerns that of a new and improved template for use as a guide for cutting and placing tile for residential or commercial use and a process for using same.

DESCRIPTION OF THE PRIOR ART

U.S. Pat. No. 5,768,793, issued to Fields, discloses an adjustable template to provide a guide while laying floor tiles of various sizes and thickness.

U.S. Pat. No. 4,712,309, issued to Kingston, discloses an adjustable template to accommodate tiles of various sizes used in laying a floor.

U.S. Pat. No. 3,254,417, issued to Carmichael, Sr., discloses a tile template comprised of a rigid frame for use in setting tiles.

SUMMARY OF THE INVENTION

The present invention concerns that of a new and improved template for use as a guide for cutting and placing tile for residential or commercial use, and a process for using same. Before using the template, a user would need to locate the center of the area onto which tiles would be placed and mark this center location. A user would place the template against the surface to which tiles would eventually be placed and then mark the template with a center mark, indication the eventual corner mark, A user would then be able to use the template to diagram the location of all necessary tiles, whether they be straight tiles or they be cut up tiles. A user would then be able to easily set the tiles by first placing the template against the required surface, and then, fixedly attaching the tiles to the template.

There has thus been outlined, rather broadly, the more important features of a tile placement template and a process for using same that the detailed description thereof that follows may be better understood and in order that the present contribution to the art may be better appreciated. There are, of course, additional features of the tile placement template and a process for using same that will be described hereinafter and which will form the subject matter of the claims appended hereto.

In this respect, before explaining at least one embodiment of the tile placement template and a process for using same in detail, it is to be understood that the tile placement template and a process for using same is not limited in its application to the details of construction and to the arrangements of the components set forth in the following description or illustrated in the drawings. The tile placement template and a process for using same is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present tile placement template and a process for using same. It is important, therefore, that the claims be regarded as including such equivalent constructions insofar as they do not depart from the spirit and scope of the present invention.

It is therefore an object of the present invention to provide a tile placement template and a process for using same which has all of the advantages of the prior art and none of the disadvantages.

It is another object of the present invention to provide a tile placement template and a process for using same which may be easily and efficiently manufactured and marketed.

It is another object of the present invention to provide a tile placement template and a process for using same which is of durable and reliable construction.

It is yet another object of the present invention to provide a tile placement template and a process for using same which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Priority is hereby claimed to application No. 60/353,262, filed on Feb. 4, 2002.

Figure 1:
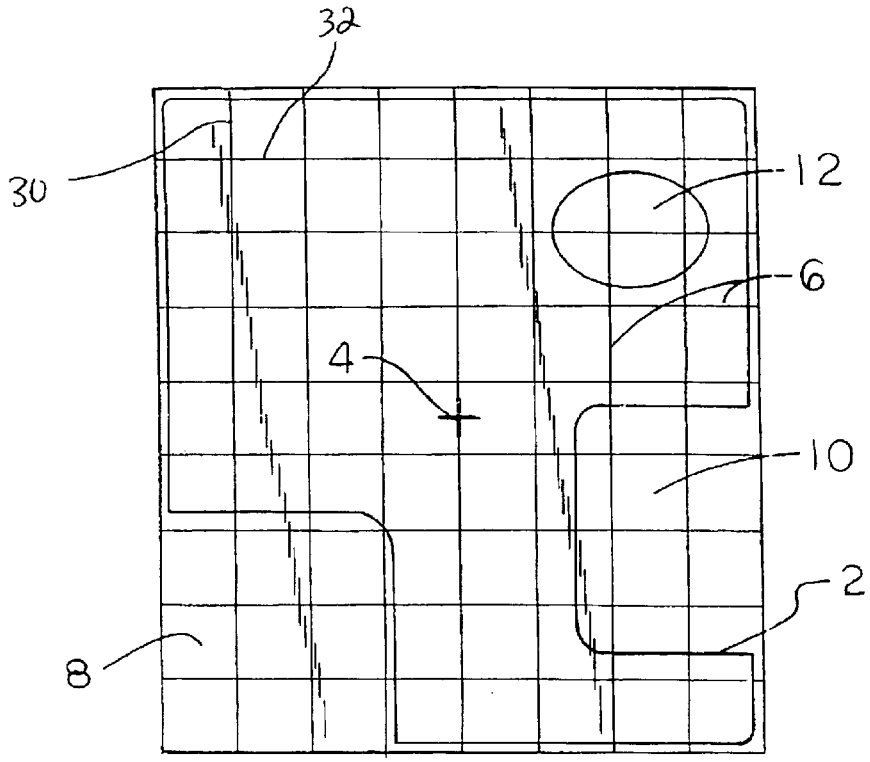
FIG. 1 shows representational view of the template used to model a residential bathroom.

FIG. 1 shows a representational view of the template 2 used to model a residential bathroom. Template 2 would be made from pliable vinyl or a vinyl-like material and would have two surfaces, a top surface and a bottom surface. Before using template 2, a user would need to locate the center of the area onto which tiles would be placed and mark this center location. Once this would be done, a user would place template 2 against the surface to which tiles would eventually be placed and then mark template 2 with a center mark 4, indicating the eventual center mark.

Once center mark 4 would be known, then a user would be able to draw all the necessary straight lines 6 on the top surface of the template to create template guidelines. A user would draw in a plurality of vertical lines 30 in one direction, and then draw in another set of horizontal lines 32 in a perpendicular direction. The vertical lines 30 would be equidistant from one another, while the horizontal lines 32 would also be equidistant from one another. Each vertical line 30 would intersection each horizontal line 32 at a ninety degree angle. Conversely, a user could use a template 2 that would already have a plurality of lines already written on the surface of template 2. This would be the ideal way to proceed if a user knew in advance the appropriate size of tiles he or she would want to use.

Once template 2 would be placed on the surface onto which tiles would eventually be placed, then a user would be able to mark off areas of known objects. In this case of FIG. 1, is known that template 2 is designed to represent the tile setting in a residential bathroom. Therefore, several items commonly associated with a bathroom are marked off, such as shower 8, sink 10 and toilet 12. A user would have previously measured dimensions of the proposed shower, sink, and toilet, so as to draw correct representational and locational diagrams of these cases on template 2.

Once the boundaries of all objects to be placed against the tile surface would be established, a user would be able to remove template 2 and determine the amount of tiles actually needed for particular project. In addition, the user would be able to determine the correct shapes and sizes of all tiles for the particular project, including the weird shapes that many of the tiles would have to be cut in order to fit properly on the desired surface to be tiled.

Figure 2:
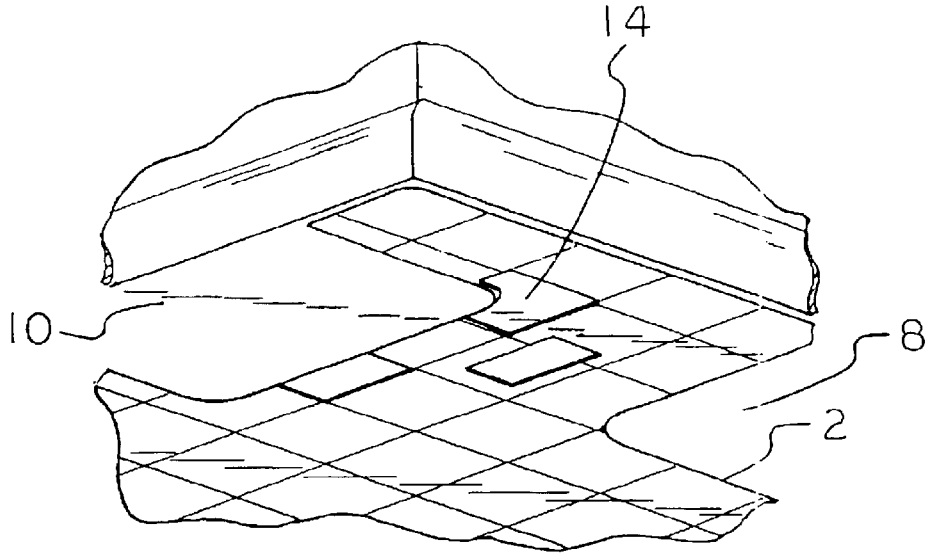
FIG. 2 shows the template actually being placed on a floor of a bathroom for use.

FIG. 2 shows the template actually being placed on a floor of a bathroom for use. Cutaway tiles 14 can be seen being placed in various locations on template 2. Without the prior setting of cutaway tiles 14, it would be much harder for a user to determine in advance what shapes and sizes of tiles to be cut would actually be needed for a particular surface. In addition, the presence of template 2 would prevent a user from having to make snap judgments when tiling a surface and would allow a user to pre-cut all needed tile at another location, if desired. Cutting tile is not easy work and template 2 would greatly simplify the process and ease of necessary tile cutting for a particular surface to be tiled.

Once all necessary tiles for template 2 had been cut and a user would want to start fixedly placing tiles against a particular surface, a user would need to first put the template 2 down on the particular surface, with the top surface of the template 2 facing up. Then, a user would be able to place tiles according to the shapes shown on template 2 and as written in to accommodate various placed objects on the particular surface. The plurality of horizontal lines 32 and vertical lines 30 would serve as guideposts, with the cut away areas also allowing individuals to determine the correct shape of various tiles and where each of these tiles should be placed.

What I claim as my invention is:

1. A process for assisting an individual to place tile, the process comprising the steps of:

(a) acquiring a template, the template being fabricated from a pliable material, the template having a length and a width correspondent to the size of the room, the template having two surfaces, a top surface and a bottom surface, (b) marking the center point on the floor surface to be tiled, (c) correspondingly marking the center point of the template, (d) drafting a plurality of vertical lines on the top surface of the template, each of the lines being equidistant from the one or two adjacent vertical lines, (e) drafting a plurality of horizontal lines on the top surface of the template, each of the lines being equidistant from the one or two adjacent horizontal lines, each of the horizontal lines intersecting each of the vertical lines, wherein each of the intersections between a horizontal line and a vertical lines is ninety degrees, (f) placing the bottom surface of the template onto a floor surface, (g) marking off areas on the top surface of the template that need to be cut away, (h) removing the template from the floor surface and cutting away the designated marked areas, and (i) determining the correct amount and shapes of needed tile in the area still covered by the template.

2. A process for assisting an individual to place tile according to claim 1 wherein the process further comprises the additional steps of:

(j) fixedly attached to the bottom surface of the template to the floor surface, and, (k) fixedly attaching the tile to the top surface of the template, using the plurality of vertical lines and the plurality of horizontal lines, along with any cut-away areas, as tile shape indicators.

3. A process for assisting an individual to place tile according to claim 2 wherein the length of the template would be between twelve and sixteen feet, and the further wherein the width of the template would be between eight and twelve feet.

4. A process for assisting an individual to place tile according to claim 3 wherein the template would be fabricated from vinyl.

* * * * *